US007445513B1

(12) United States Patent
Lee

(10) Patent No.: US 7,445,513 B1
(45) Date of Patent: Nov. 4, 2008

(54) POWER ADAPTOR EQUIPPED WITH MULTI-PLUG AND MULTI-OUTLET

(75) Inventor: Anthony Lee, Dong Guan (CN)

(73) Assignee: Dongguan Ahoku Electronic Company, Guang Dong (CN)

( * ) Notice: Subject to any disclaimer, the term of this patent is extended or adjusted under 35 U.S.C. 154(b) by 0 days.

(21) Appl. No.: 12/025,938

(22) Filed: Feb. 5, 2008

(30) Foreign Application Priority Data

Oct. 13, 2007 (CN) ..... 2007 2 0172458 U

(51) Int. Cl.
*H01R 25/00* (2006.01)

(52) U.S. Cl. ..... 439/652; 439/653; 439/131; 439/518

(58) Field of Classification Search ..... 439/131, 439/650–655, 172, 174, 176, 135, 535
See application file for complete search history.

(56) References Cited

U.S. PATENT DOCUMENTS 5,702,259 A * 12/1997 Lee ..... 439/137
6,042,426 A * 3/2000 Byrne ..... 439/654
6,302,743 B1 * 10/2001 Chiu et al. ..... 439/652
6,638,076 B2 * 10/2003 Wang ..... 439/39
6,923,666 B1 * 8/2005 Liao ..... 439/131
6,935,878 B2 * 8/2005 Hsu et al. ..... 439/174
7,008,246 B2 * 3/2006 Zhuge ..... 439/173
7,121,834 B2 * 10/2006 Gerard ..... 439/21
7,179,105 B1 * 2/2007 Hung ..... 439/518
7,354,286 B1 * 4/2008 Lee ..... 439/172

* cited by examiner

*Primary Examiner*—Briggitte R Hammond
(74) *Attorney, Agent, or Firm*—Banger Shia

(57) ABSTRACT

A power adaptor equipped with multi-plug and multi-outlet comprises more than one different specification plug and more than one different specification outlet. The respective plugs can be pushed out of a body of the adapter via a rotary pillar. The rotary pillar is disposed in the center of an area defined by the different specification plugs and is rotatable relative to the respective plugs. The surface of the rotary pillar has helical grooves, each plug a flange toward a corresponding groove in the rotary pillar, and the flange can slide into and along the corresponding helical groove.

6 Claims, 4 Drawing Sheets

POWER ADAPTOR EQUIPPED WITH MULTI-PLUG AND MULTI-OUTLET

BACKGROUND OF THE INVENTION

1. Field of the Invention

The present invention relates to a power adapter which is integrated by plugs and outlets, and more particularly to a power adaptor equipped with multi-plug and multi-outlet, which only allows a single plug to be pushed out while other plugs are locked.

2. Description of the Prior Art

As the international exchange becomes increasingly closer, the interoperability of the electronic products of every country becomes wider and wider. For example, a user can directly buy oversea electronic products to use in his own country, or the tourists or the business people can take with them the mobile phone, digital camera, the notebook computer or other electronic products while going abroad. An electronic product has a fixed standard plug, while every country almost has different standard plugs/outlets, and the type and dimension difference of the plugs/outlets is significant. In order to facilitate these electronic products being used in different countries, people use a power converter to solve this problem. The power converter is an adapter integrated by different standard plugs and outlets.

An existing adapter comprises an outlet on one side surface thereof suitable for one or multiple standard plugs. The joints of the multiple different standard plugs on the opposite surface can be moved to an effect position. These plug joints can be moved out through the pins in the sliding gaps. The sliding gaps where the plug joints are not moved out are covered by actuating members, so that only one plug joint can be moved out. In addition, a safety member is used to install the plug joints at the effect positions for preventing the plug joint which is moving forward from retracting accidentally.

The existing power adapters have various quality and safety problems. Since when the power adapter is used and a single standard plug is inserted into the outlet, if there is no other plug locking device, other plugs can also be synchronously pushed out. Therefore, due to the carelessness of the user, it is likely to cause the electric shock.

SUMMARY OF THE INVENTION

The primary objective of the present invention is to provide a power adaptor equipped with multi-plug and multi-outlet, which is integrated by multiple different standard plugs and multiple different standard outlets. The plugs are retracted into or pushed out of a body of the adapter via a rotary pillar with helical grooves, so that when one plug is pushed out, other plugs cannot be pushed outside, thus solving the disadvantage of the existing power adapters.

In order to achieve the above objective, a power adapter in accordance with the present invention comprises more than one different specification plug and more than one different specification outlet. The respective plugs can be pushed out of the body of the adapter, wherein the respective plugs are pushed out of the body of the adapter via a rotary pillar. The rotary pillar is positioned in the center of an area defined by the different specification plugs and is rotatable relative to the respective plugs. The surface of the rotary pillar has helical grooves. Each plug has a flange toward a corresponding groove in the rotary pillar, and the flange can slide into and along the corresponding groove of the rotary pillar.

The power adapter in accordance with the present invention further comprises:

The surface of the rotary pillar has more than one helical groove, wherein the helical grooves have different helical directions and different helical angles.

The rotary pillar has a hollow space in which a fuse is disposed, and both ends of the fuse are connected to conductors of the plugs and the outlets.

The plug is disposed with a button the moving direction of which is vertical to the sliding direction of the plug, between the buttons and the plugs are disposed springs.

The rotary pillar is installed with returning springs.

The rotary pillar is installed with one or more positioning magnets, a housing or plug of the adaptor is installed with one or more positioning magnets to fix the rotary pillar after retracting plug.

The adapter further comprises surge protection devices, surge protection indicators, power indicators.

The adapter further comprises voltage discrimination indicators.

The outlet further includes a USB power output interface.

The power adapter in accordance with the present invention has the following useful effect: with the cooperation structure of the rotary pillar and multiple different standard plugs, only one of the different standard plugs can be pushed out while other plugs are locked. Therefore, the present invention has the advantages: simplified and logical structure, wide range of application, low cost, safety, convenient to carry and use and so on.

BRIEF DESCRIPTION OF THE DRAWINGS

FIG. 2 and FIG. 4 are the similar structure, only with different sharp of the rotary pillars.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Referring to FIGS. 1-4, a power adapter in accordance with the present invention comprises multiple different standard plugs integral with multiple standard outlets, wherein the different standard plugs can be pushed out from a lower end of the adapter according to the requirements. The power adapter in accordance with the present invention is characterized in that: a power adapter comprises more than one different specification plug integral with more than one different specification outlet, the respective plugs can be pushed out of a body of the adapter, and a rotary pillar capable of rotating relative to the respective plugs is positioned in the center of an area defined by the different specification plugs, the surface of the rotary pillar has helical grooves, each plug has a flange toward a corresponding groove in the rotary pillar, and the flange can slide into the corresponding helical groove. When the selected plug is pushed out, the flange of the selected plug slides along the helical groove of the rotary pillar, so that the rotary pillar rotates with the movement of the flange of the selected plug and the flanges of other plugs cannot slide into the corresponding helical grooves, thus achieving the function that only a single plug can be pushed out. In the center of an area defined by the respective plugs of the adapter is disposed a rotary pillar with helical grooves, each plug has a flange toward the rotary pillar, and the flange can slide along the corresponding helical groove in the rotary pillar.

Figure 1:
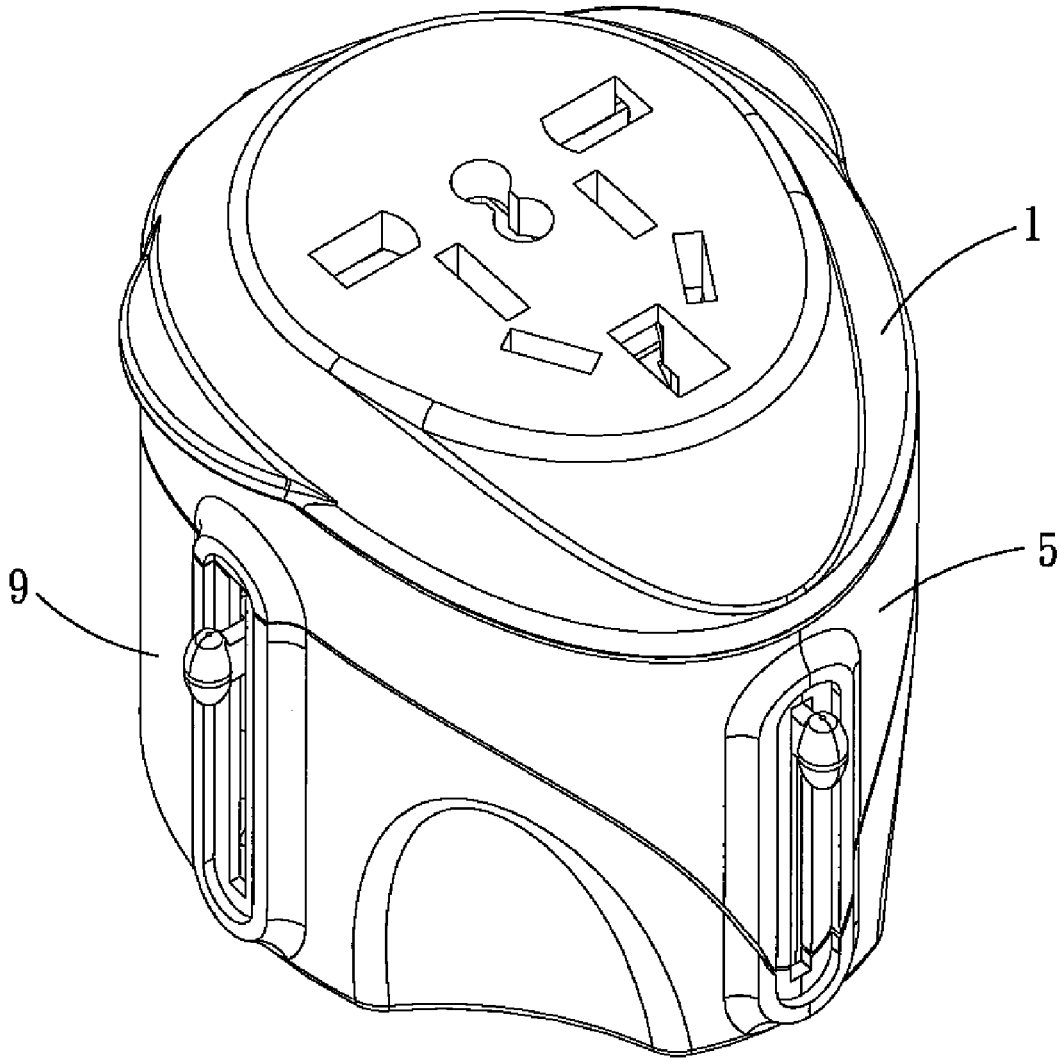
FIG. 1 is a perspective view of a power adaptor equipped with multi-plug and multi-outlet in accordance with the present invention.
Figure 2:
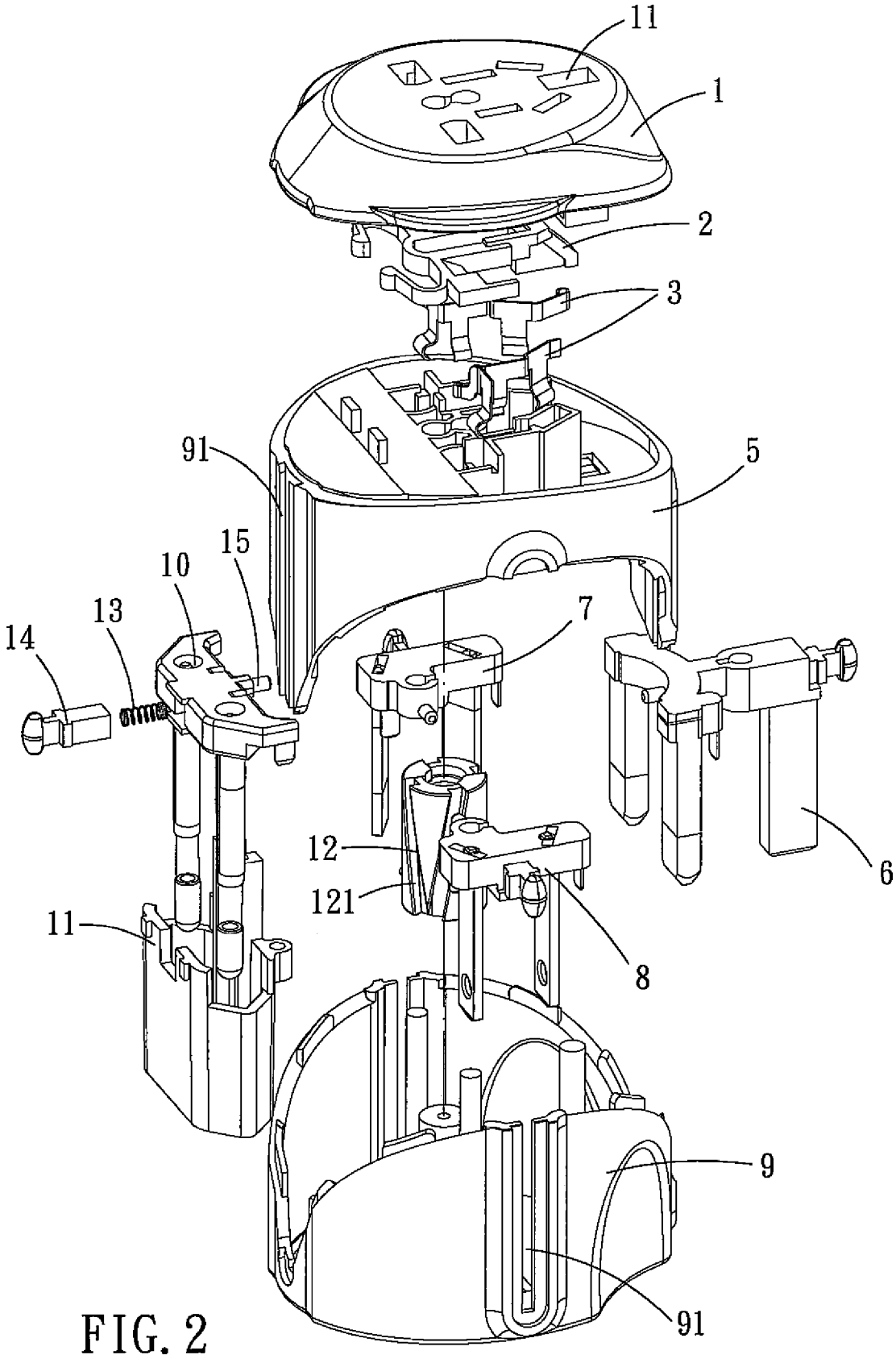
FIG. 2 is an exploded view of the power adaptor equipped with multi-plug and multi-outlet in accordance with the present invention of FIG. 1.
Figure 3:
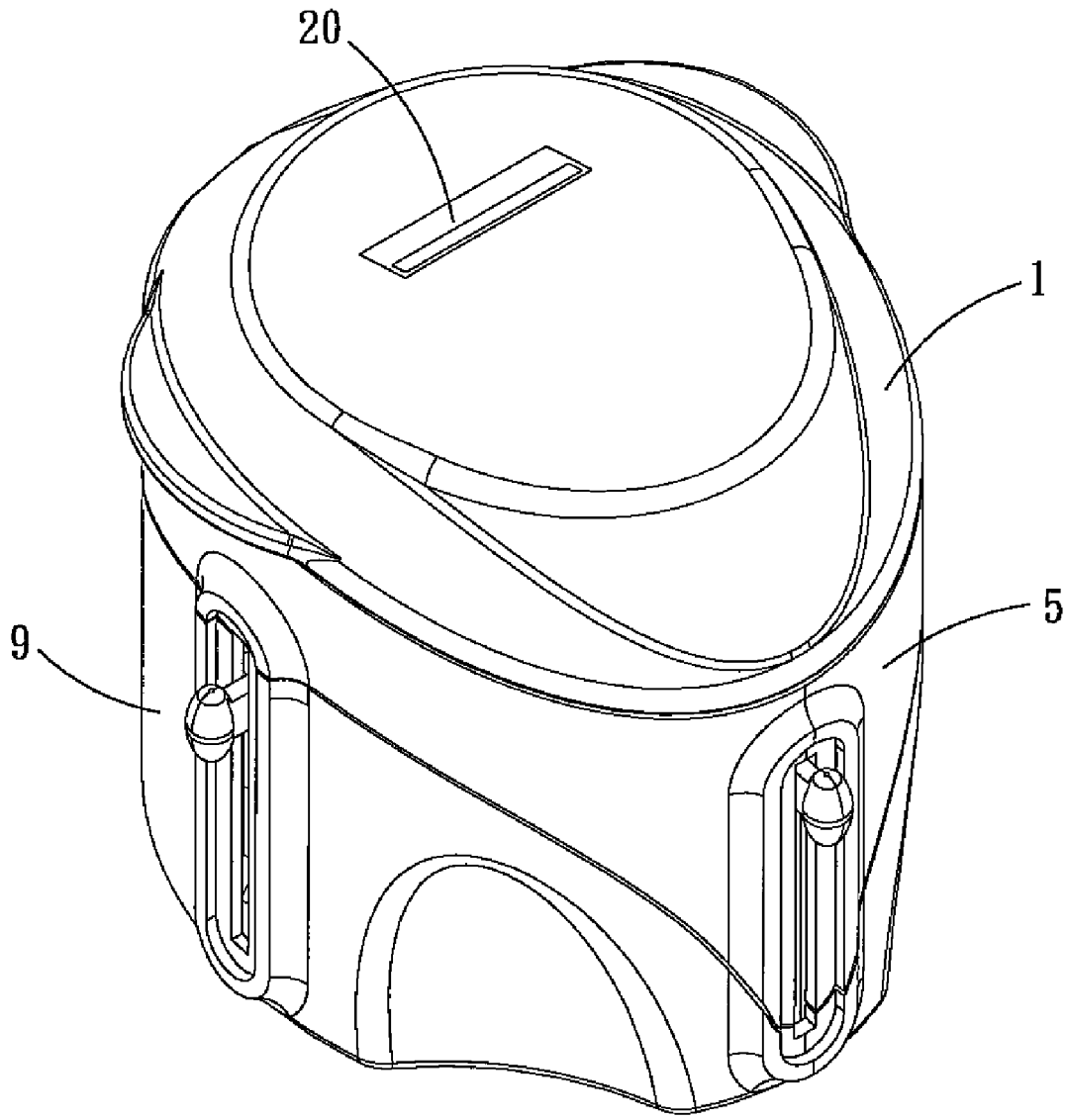
FIG. 3 is a structural view of USB outlet in accordance with the present invention.
Figure 4:
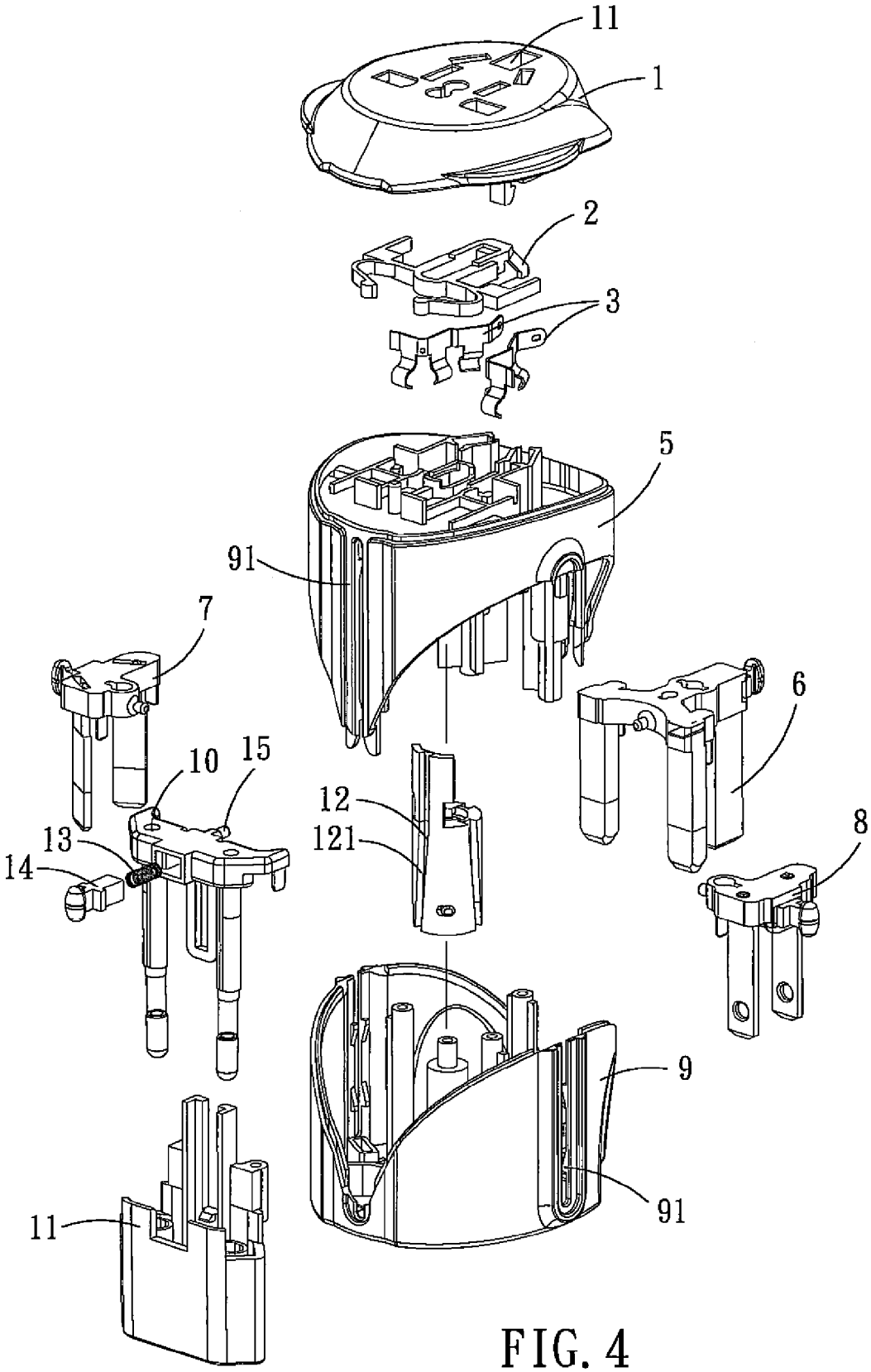
FIG. 4 is an exploded view of power adaptor equipped with multi-plug and multi-outlet in accordance with the present invention.

Referring to FIGS. 2-4, an adapter in accordance with one embodiment of the present invention comprises a housing 5, a lower cover housing 9, an upper cover housing 1, conductive copper straps 3 (as shown in FIG. 3 and FIG. 4), a British plug 6, an Australian plug 7, an United State plug 8, a European plug 10, and a rotary pillar 12. The upper end of the housing 5 is connected to the upper cover housing 1, and the lower end of the housing 5 is connected to the lower cover housing 9. Between the housing 5 and the upper cover housing 1 is disposed conductive copper strap 3. The upper cover housing 1 is disposed on the surface thereof with different standard outlets 11 or a Universal Serial Bus (USB) power interface 20. The outlets 11 correspond to the conductive copper straps 3. The housing 5 and the lower cover housing 9 are respectively disposed with plug sliding grooves 91 in the circumferential surfaces thereof, wherein the housing 5 is disposed with 4 plug sliding grooves 91, the lower cover housing 9 is disposed with 4 plug sliding grooves 91, and the four plug sliding grooves 91 are rectangularly distributed. Between the housing 5 and the lower cover housing 9 are disposed plugs 6, 7, 8, 10 and the rotary pillar 12, wherein each plug 6, 7, 8, 10 includes a button 14 and a flange 15. The rotary pillar 12 is disposed with helical grooves 121 cooperating with the flanges 15. The buttons 14 can slide along the plug sliding grooves 91.

FIG. 4 shows an adapter in accordance with another embodiment of the present invention. The difference between the present embodiment and the above embodiment is the installation way of the rotary pillar 12.

When in use, the button of one plug is pushed, so as to make the flange move into the corresponding helical groove of the rotary pillar, and then the button is pushed downward again to move downward along the plug sliding groove. At this moment, the flange slides downward along the helical groove. When the button is pushed to a predetermined position, under the action of the spring, the button will return to its original position and will be engaged at an engaging opening of the sliding groove of the plug. At this moment, the rotary pillar is rotated, so that other plug flanges cannot be pushed out since they are unable to move into the helical grooves. After the above plug is used, the plug button is pushed again, so that the plug will retract into the housing and the lower cover housing.

While we have shown and described various embodiments in accordance with the present invention, it is clear to those skilled in the art that further embodiments may be made without departing from the scope of the present invention.

What is claimed is:

1. A power adaptor equipped with multi-plug and multi-outlet, comprising:

more than one different specification plug and more than one different specification outlet, the respective plugs being able to be pushed out of a body of the adaptor, characterized in that: the plugs are pushed out of the adaptor via a rotary pillar which is positioned in the center of an area defined by the different specification plugs, and the rotary pillar is rotatable relative to the respective plugs, a surface of the rotary pillar has helical grooves and each plug has a flange toward a corresponding groove in the rotary pillar, and the flange is able to slide into and slide along the corresponding helical groove.

2. The power adaptor equipped with multi-plug and multi-outlet as claimed in claim 1, characterized in that the surface of the rotary pillar has more than one helical groove, and the helical grooves have different helical directions and different helical angles.

3. The power adaptor equipped with multi-plug and multi-outlet as claimed in claim 1, characterized in that the rotary pillar has a hollow space in which a fuse is disposed, both ends of the fuse are connected to conductors of the plugs and the outlet.

4. The power adaptor equipped with multi-plug and multi-outlet as claimed in claim 1, characterized in that the rotary pillar is disposed with returning springs.

5. The power adaptor equipped with multi-plug and multi-outlet as claimed in claim 1, characterized in that the rotary pillar is installed with one or more positioning magnets, a housing or plug of the adaptor is installed with one or more positioning magnets to fix the rotary pillar after retracting plug.

6. The power adaptor equipped with multi-plug and multi-outlet as claimed in claim 1, characterized in that the outlet further includes a Universal Serial Bus power output interface.

* * * * *